US010398184B1

(12) United States Patent
Farkas

(10) Patent No.: US 10,398,184 B1
(45) Date of Patent: Sep. 3, 2019

(54) BELT WITH RECEPTACLE AND REMOVABLE DECORATIVE FRONT PORTION

(71) Applicant: Hadassah Farkas, Brooklyn, NY (US)

(72) Inventor: Hadassah Farkas, Brooklyn, NY (US)

( * ) Notice: Subject to any disclaimer, the term of this patent is extended or adjusted under 35 U.S.C. 154(b) by 0 days.

(21) Appl. No.: 15/695,070

(22) Filed: Sep. 5, 2017

(51) Int. Cl.
*A41F 9/00* (2006.01)
*A45C 1/04* (2006.01)

(52) U.S. Cl.
CPC ..... *A41F 9/002* (2013.01); *A45C 1/04* (2013.01)

(58) Field of Classification Search
CPC ..... A41F 9/002; A45F 1/04
USPC ..... 224/660
See application file for complete search history.

(56) References Cited

U.S. PATENT DOCUMENTS 2,885,684 A * 5/1959 Dye ..... A41F 9/002 2/300
3,848,270 A * 11/1974 Rand ..... A41F 9/002 2/311
4,446,574 A * 5/1984 Kalomeris ..... A45C 1/04 2/247
4,525,879 A * 7/1985 Kalomeris ..... A45C 1/04 2/247
4,905,881 A 3/1990 Graber
5,102,023 A 4/1992 Nguyen
5,115,519 A * 5/1992 Dalrymple ..... A41D 27/20 2/247
5,215,237 A 6/1993 Wu
5,299,325 A * 4/1994 Kamber ..... A41F 9/002 2/338
5,794,769 A * 8/1998 Tomlinson ..... A61F 6/005 150/900
D397,838 S * 9/1998 Waggoner ..... D14/192
6,189,154 B1 * 2/2001 Ducharme ..... A45C 13/02 2/247
6,325,260 B1 * 12/2001 Gorham ..... A45C 1/04 206/69
7,574,753 B1 * 8/2009 Seyfried ..... A41D 27/085 2/311
D703,394 S * 4/2014 Bozeman ..... D30/152
8,850,621 B2 * 10/2014 Carter-Cohen ..... A45F 5/022 2/300
9,277,775 B2 3/2016 Lopez
D818,667 S * 5/2018 Pelengaris ..... D2/627
2008/0190980 A1 * 8/2008 Overton ..... A45F 3/14 224/664
2012/0012630 A1 * 1/2012 Lui ..... A41F 9/002 224/660
2013/0048687 A1 * 2/2013 Do ..... A45F 3/14 224/222

(Continued)

*Primary Examiner* — Peter N Helvey
(74) *Attorney, Agent, or Firm* — Michael J. Feigin, Esq.; Feigin and Fridman LLC

(57) ABSTRACT

A belt with hidden receptacle is disclosed. The receptacle or pouch opens on only one side, such as a top side, and is within a belt. Items can be placed there-in which lie flat (money, credit cards, phone) along a longest length thereof and the belt can be covered with a removable front cover. This removable front cover can match the dress or have the same pattern, fabric, or material as a portion of the dress so as to appear to be a unitary portion of the dress itself. The front cover can be attached by magnets on either end thereof, while the belt attaches to itself at ends thereof, which are at an opposite side of the length of the belt from the front cover.

13 Claims, 8 Drawing Sheets

(56) References Cited

U.S. PATENT DOCUMENTS

2016/0143424 A1* 5/2016 Stephens ..... A45F 3/005
224/222

* cited by examiner

BELT WITH RECEPTACLE AND REMOVABLE DECORATIVE FRONT PORTION

FIELD OF THE DISCLOSED TECHNOLOGY

The disclosed technology relates generally to belts worn as clothing, and more specifically, to such belts with receptacles for storing items.

BACKGROUND

Women's apparel, especially formal apparel, is typically designed without pockets. As such, women often carry purses or other bags to store items they wish to carry. This can include money, credit cards, cellular phones and the like. While devices such as "fanny packs" exist allowing one to place items in a pocket secured around their waist, these are far from flattering and inappropriate for a formal setting or a "put together" look.

What is needed is a way to allow women (and men) to carry items on their person with their formal attire without having to compromise on elegance and appearance. Thus, pouches or pockets should not interfere with the exterior look of a person in nice clothing but must be invisible or complimentary to the look.

SUMMARY OF THE DISCLOSED TECHNOLOGY

A belt of embodiments of the disclosed technology has connectors at extreme and opposite ends thereof. In this manner, the belt can be connected to itself in a loop. Equidistant from these ends, near (defined as "within 20% of) a center of the length of the belt, in some embodiments, is a removable front portion or front cover. (In this disclosure, "front portion" and "front cover" are synonymous and used interchangeably.) This removable front portion partially, fully, or substantially covers a receptacle within the belt, such as within an inside of the belt. Thus, a continuous belt extends from end to end without obstruction, while interior to the belt (on an opposite side of a removable portion) is the receptacle. This receptacle, in embodiments of the disclosed technology, only opens on one side of the belt such as a top side, the top being relative to the ground or a person wearing the belt (such that opening is on a side pointing towards or closest to a torso of a wearer who wears the belt on a waist, for example). This opening is in parallel with the most elongated length of the belt.

The (removable) front portion has connectors fixed thereto, such as sewn inside the front portion. These connectors can be magnets and include one, or a set of, left-side connectors and one, or a set of, right-side connectors. So too, the belt has corresponding left and right side connectors (one or a set). "Right" and "left" are relative to the top of the belt and/or the orientation of the wearer of the belt. A distance between the left-side connectors of the front portion and the right-side connectors of the front portion is equal to a distance from the left-side connectors of the belt to the right-side connectors of the belt, or substantially there-so, in order to enable the left and right connectors of the belt and removable front portion, respectively, to connect to one another.

Still further, one belt can accommodate a plurality of differently sized removable front connectors. This is accomplished by having multiple sets of connectors on the belt, and a set of connectors spaced apart a different distance from a center of the belt or central point of the left side and right side connectors. In this manner, one can attach a different removable front portion than the first-described one, having left/right connectors spaced apart from each other at a different distance than that of the first-described removable portion.

In this manner, the front portions can be of various, different, longest lengths while being interchangeably and removably connectable to the belt. One or more of these removable front portions can have fabric cut from a dress over which said belt is worn, or have a pattern (including a style, texture, or the like) which is on a portion of a dress over which said belt is worn. That is, a front portion can match the dress or be from the same material as part of the dress.

The connectors, such as magnets, can be hidden from view when a removable front portion is connected or disconnected. This can be because the magnets are sewn into the belt and covered by the fabric of the belt (or front portion). The magnets can be spaced apart from each other such that, for example, each left and right side connector has a top and bottom magnet. These sets of magnets (left and right, of each respective belt/front portion) can be equidistant from one of the connectors at the extreme end of the belt, and a corresponding other set (e.g. a right set which corresponds to a left set) can further be equidistant from an extreme end of the belt.

The belt can have a continuous length of fabric between the extreme and opposite ends thereof. This receptacle can be fixedly connected to an inside of the belt such that from the outside, the belt is uninterrupted (although covered, in embodiments, by a front portion). The side of the belt with the removable front portion is the "outside" of the belt while the opposite side is the "inside" of the belt. The receptacle is sealable along an entirety of the receptacle, a front portion of the belt (the portion with a removable cover), or substantially an entirety of one of these lengths.

In a method of use, one can do the following in any order. One can align the left-side and the right-side connectors of one of the removable front portions to respective connectors of the belt. One can removably attach a removable front portion to the belt. One can attach extreme and opposite ends of the belt to each other such that the opening of the receptacle points substantially upward relative to the ground or a wearer of the belt. One can remove one of the removable front portions and attach a different front portion to the belt in the same place that the prior front portion was attached. One can also place items within the receptacle while donning the belt.

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

A belt with hidden receptacle is disclosed. The receptacle or pouch opens on only one side, such as a top side, and is within a belt. Items can be placed there-in which lie flat (money, credit cards, phone) along a longest length thereof and the belt can be covered with a removable front cover. This removable front cover can match the dress or have the same pattern, fabric, or material as a portion of the dress so as to appear to be a unitary portion of the dress itself. The front cover can be attached by magnets on either end thereof, while the belt attaches to itself at ends thereof, which are at an opposite side of the length of the belt from the front cover.

Embodiments of the disclosed technology will become clearer in view of the following description of the figures.

Figure 1:
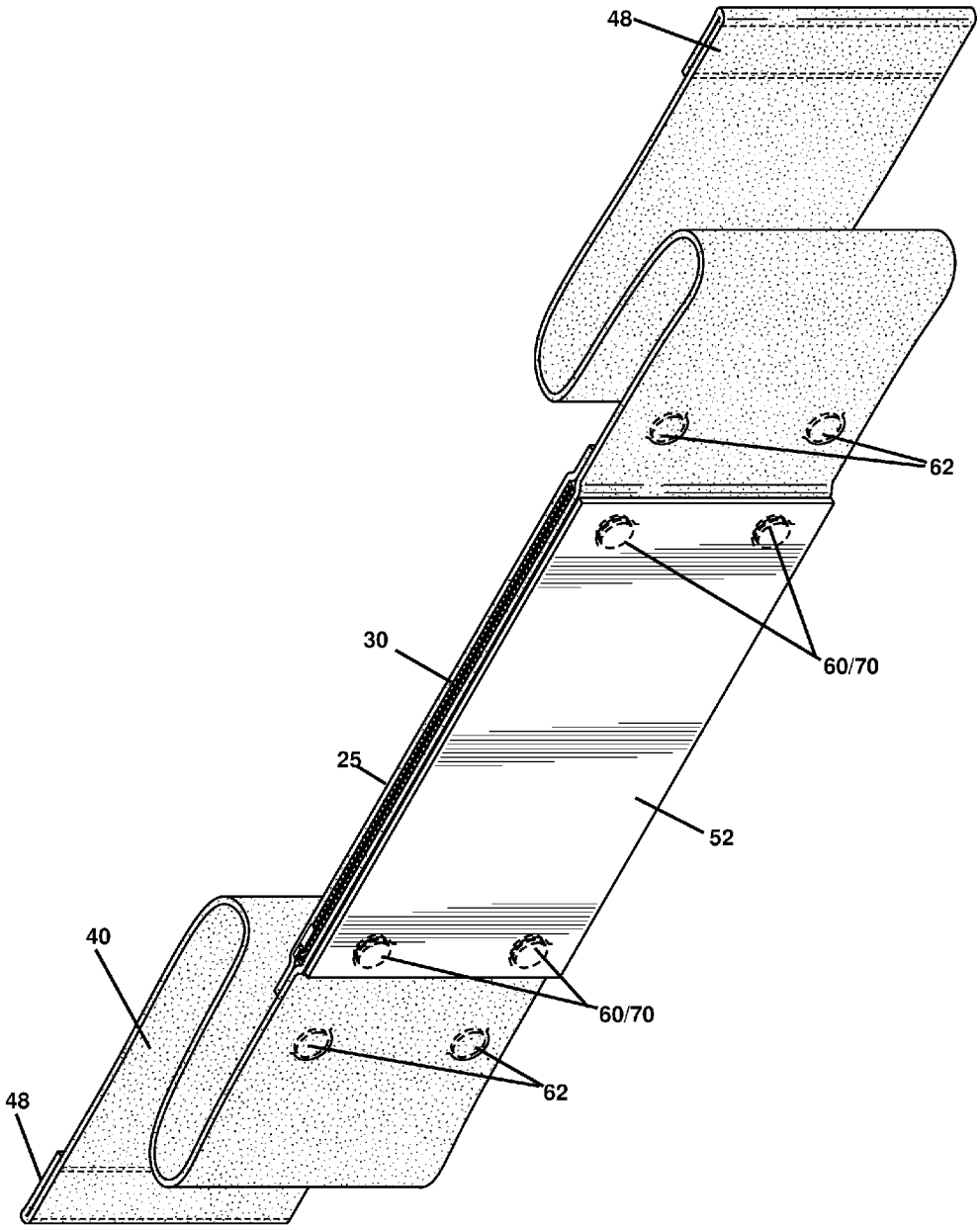
FIG. 1 shows an outside and top perspective view of a belt with removable cover attached thereto, in an embodiment of the disclosed technology.

FIG. 1 shows an outside and top perspective view of a belt with removable cover attached thereto, in an embodiment of the disclosed technology. The belt 40 comprises two extreme ends 48 which make up no more than 10% of the most elongated length of the belt and often much less, such as encompassing the width of the connectors themselves to the extreme ends of the length of the belt on each end. These connector regions connect to each other by way of connectors 49, such as snaps, magnets, or fasteners. Across and center point between these two extreme ends 48 is a front portion of the belt. This front portion has connectors 60 and/or 62 alone or in pairs which are equidistant from the center point between the two extreme ends 48 or another central axis which is equidistant between each two same-numbered connectors 60 or 62 of the belt.

There are two sets of connectors, in some embodiments, on the belt 40. A first set of connectors 60 has left and right connectors, as shown, and a second set of connectors 62 also has left and right connectors. In some embodiments, these connectors are sewn into the fabric of the belt itself and can be magnets or snaps. When the connectors are magnets, the connectors may be invisible when viewing any portion of the exterior of the belt and cover 52. When the connectors are snaps, the snaps are invisible or substantially invisible to a viewer when a cover 52 is attached to the belt.

On a top side 25 of the belt is an opening 30. In some embodiments, this opening is the sole and only opening into a receptacle which is fixedly connected to the belt. "Fixed" or "fixedly" is defined as "designed for permanent attachment which requires destruction of seams or stitching in order to disconnect." "Removable" or "removably", by contrast, is defined as "able to disconnect and reconnect at least one hundred times without causing structural damage to the parts which are disconnected and reconnected to each other." The opening can be closed and opened using a zipper in embodiments of the disclosed technology. Note that, in embodiments of the disclosed technology, the zipper and receptacle is entirely inside a continuous length of belt 40. This enables the belt to appear more continuous and flat to a viewer of a person wearing the belt. Likewise, items within the receptacle can be placed such that their longest length is parallel or substantially parallel to the longest length of the receptacle. A phone can be placed such that its side is toward the top of the pouch, a credit card with its top toward the top of the pouch, and so forth.

In FIG. 1, a first cover or first portion 52 has an outer side (where the number 52 is placed) facing away from the belt towards the outside. This cover has side connectors 70 on its left and right side, as two, spaced-apart connectors such that one is at a top and one is at a bottom of each side of the cover. For purposes of this disclosure, a "top", "bottom", "left", and "right" portion of an object is defined by dividing the object by its fourths and each direction and assigning region names, respectively, of either "top, top middle, bottom middle, bottom" or "left, left middle, right middle, right" depending on which is appropriate.

Figure 2:
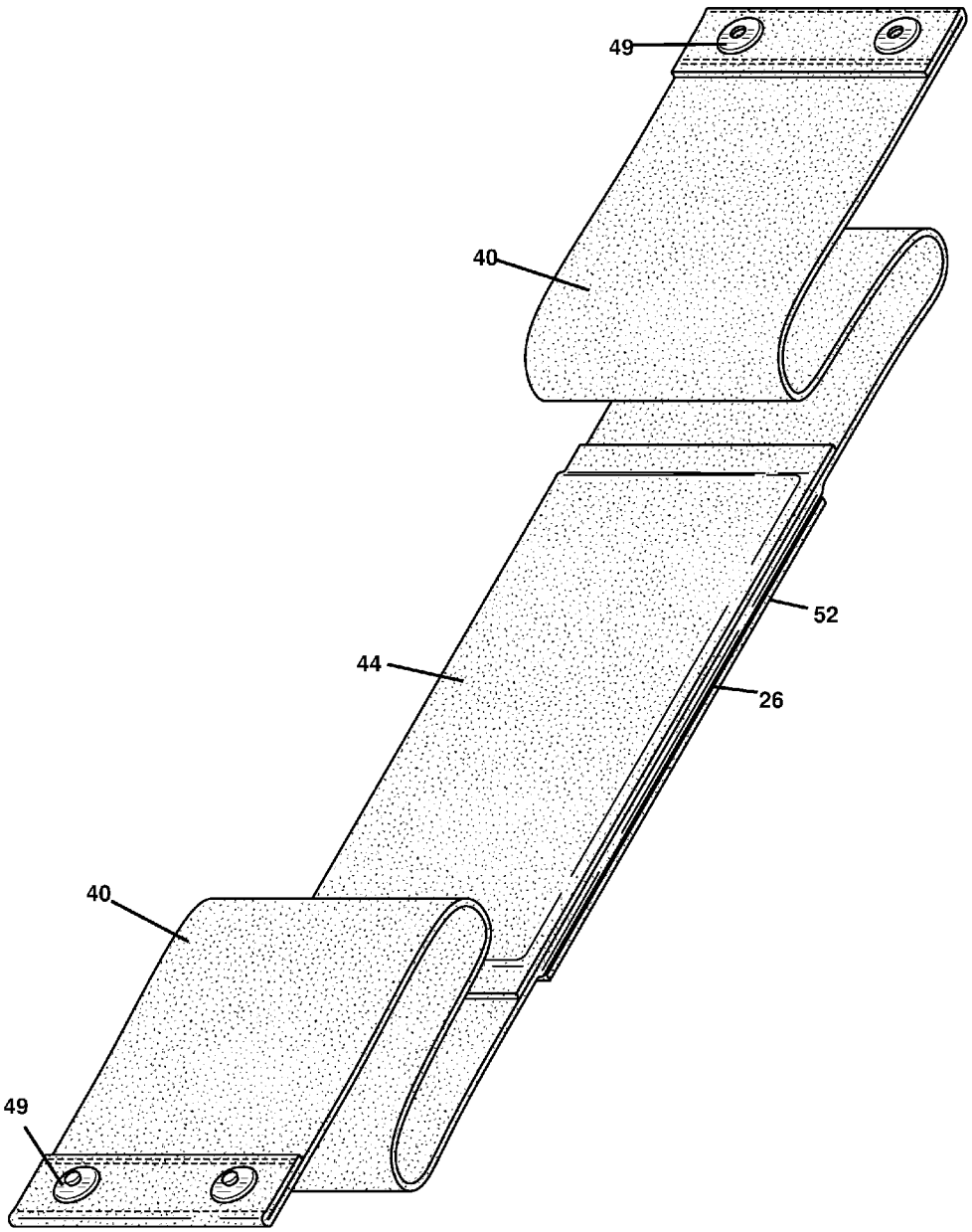
FIG. 2 shows an inside and bottom perspective view of a belt with removable cover attached thereto, in an embodiment of the disclosed technology.

FIG. 2 shows an inside and bottom perspective view of a belt with removable cover attached thereto, in an embodiment of the disclosed technology. Here, one can see the center region 55 of the belt 40. The center region 55 is the region which is adjacent to, has connected thereto, or is bulged out by the pouch or receptacle. It can include the center or substantially a center between two opposite ends of the entirety of the belt. The bottom edge of the receptacle 26 is also shown, as are the connectors 49 on the extreme ends of the belt 40. Here, the extreme ends of the belt are further defined by a fold in the fabric separating such portion of the belt from the rest. The connectors 49, or one set thereof, can be on an opposite side of the fabric of the belt than shown.

Figure 3:
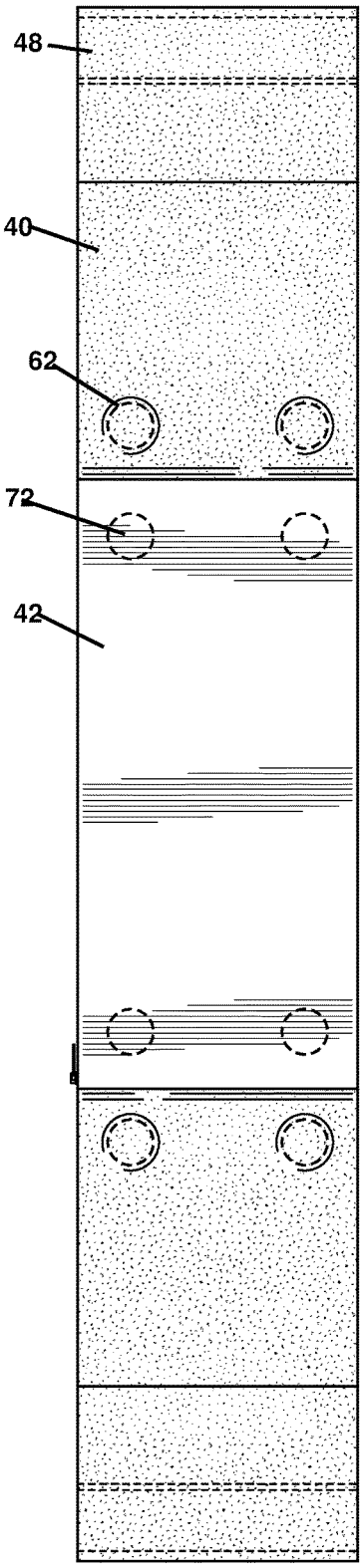
FIG. 3 shows an outside plan view of a belt with removable cover of an embodiment of the disclosed technology.

FIG. 3 shows an outside plan view of a belt with removable cover of an embodiment of the disclosed technology. Here, one can see the outlines where the hidden connectors 62 and 72 are placed and the outer side 42 of the removable cover.

Figure 4:
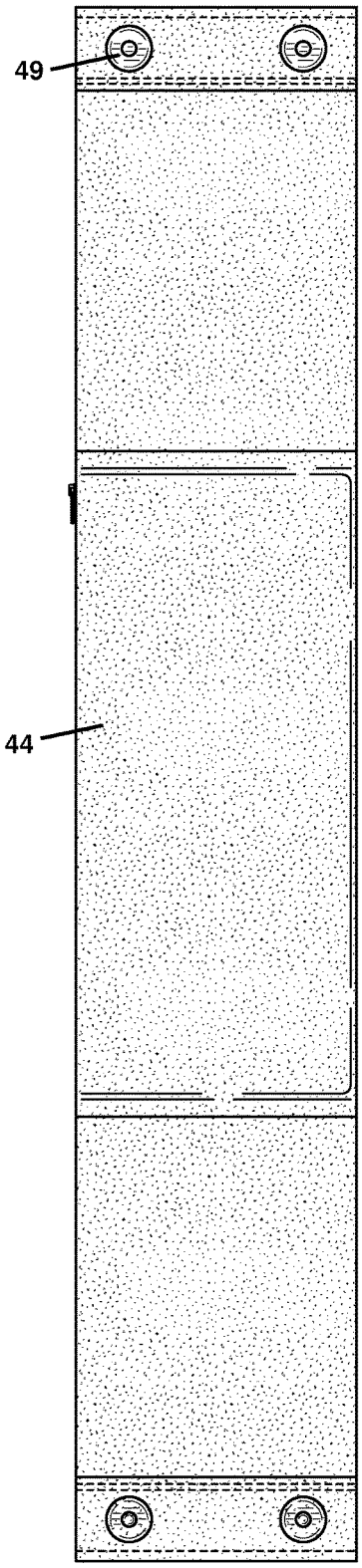
FIG. 4 shows an inside plan view of a belt with removable cover of an embodiment of the disclosed technology.

FIG. 4 shows an inside plan view of a belt with removable cover of an embodiment of the disclosed technology. Here one can see the end connectors 49 which connect the belt to itself so that the belt forms a loop as well as the inner depression of the pouch or receptacle 44.

Figure 5:
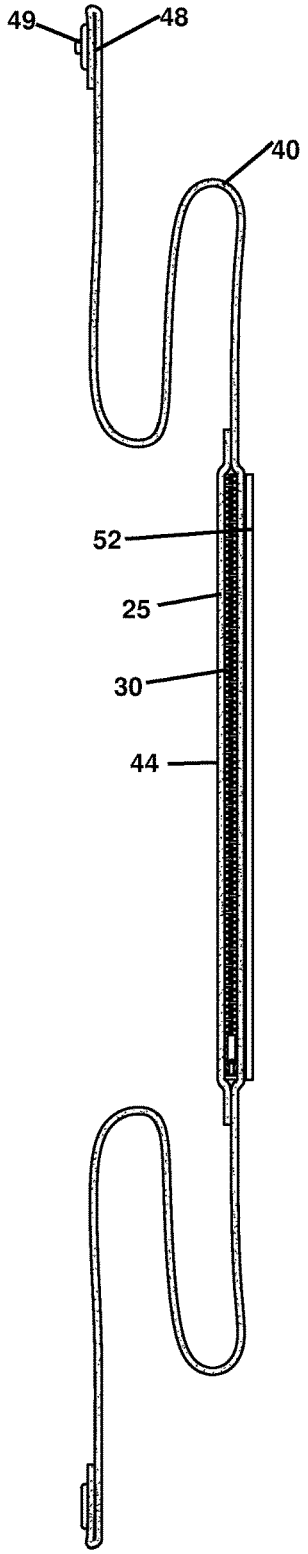
FIG. 5 shows a top edge view of a belt with removable cover of an embodiment of the disclosed technology.

FIG. 5 shows a top edge view of a belt with removable cover of an embodiment of the disclosed technology. When viewed from the top, one can see the top side 25 of the belt, the top side of the inner portion 44 of the receptacle, the continuous nature of the belt 40 in this embodiment, and the top side 52 of the removable cover which is removably attached to the belt.

Figure 6:
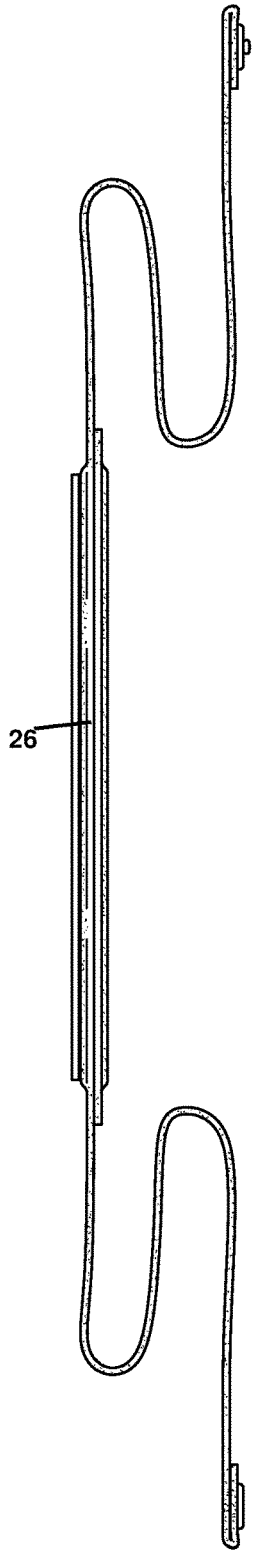
FIG. 6 shows a bottom edge view of a belt with removable cover of an embodiment of the disclosed technology.

FIG. 6 shows a bottom edge view of a belt with removable cover of an embodiment of the disclosed technology. The bottom side 25 of the receptacle is visible. Note that, most of the added bulk (thickness of the device as a whole) compared to the belt 40 by itself is on the inside of the belt. The only added thickness on the outside of the belt at the region defined by the receptacle/cover is from the cover itself in some embodiments. In this manner, it appears to an observer that the added thickness is from the cover alone, the receptacle with contents completely undetectable by an ordinary observer.

Figure 7:
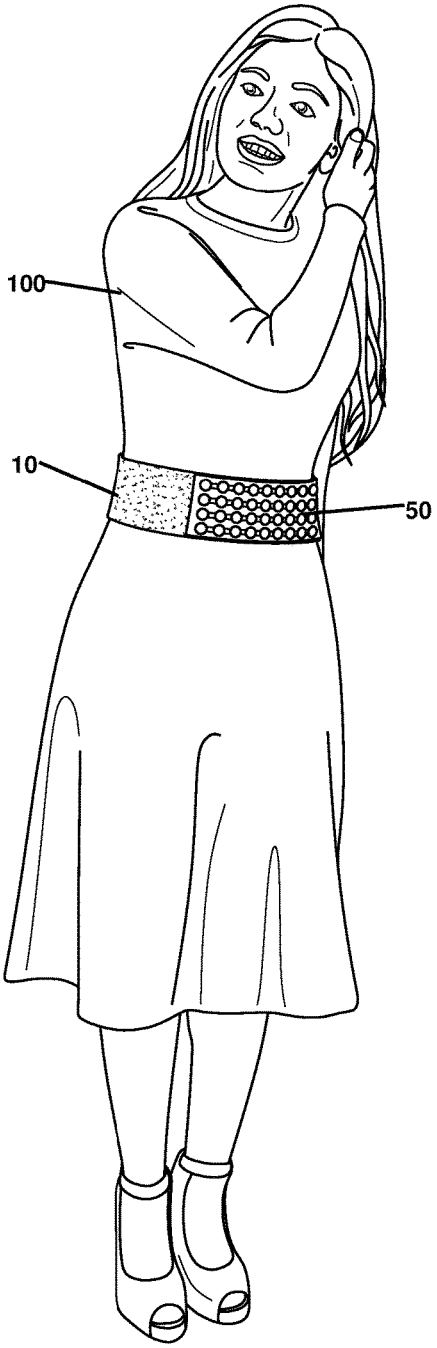
FIG. 7 shows a belt with removable cover worn on a person in an embodiment of the disclosed technology.

FIG. 7 shows a belt with removable cover worn on a person in an embodiment of the disclosed technology. Note that the belt has an exterior pattern 10 which matches a pattern of a portion of the dress 100 on the wearer. The removable cover 50 has a design which can also match a portion of the dress. Either or both can be taken from the same material as a portion of the dress 100, or cut from the dress 100.

Figure 8:
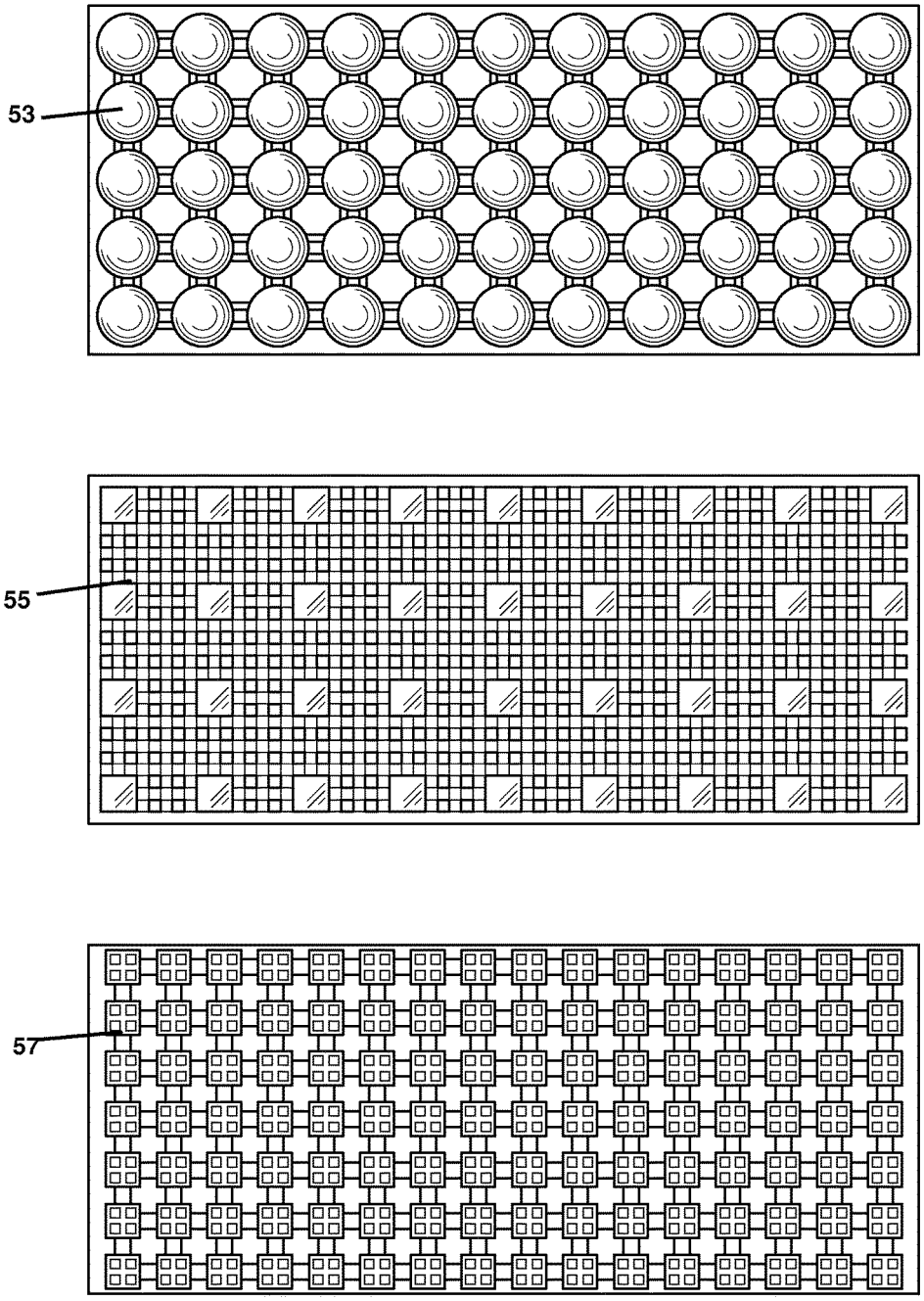
FIG. 8 shows a variety of removable covers of embodiments of the disclosed technology.

FIG. 8 shows a variety of removable covers of embodiments of the disclosed technology. These includes patterns 53, 55, and 57.

Figure 9:
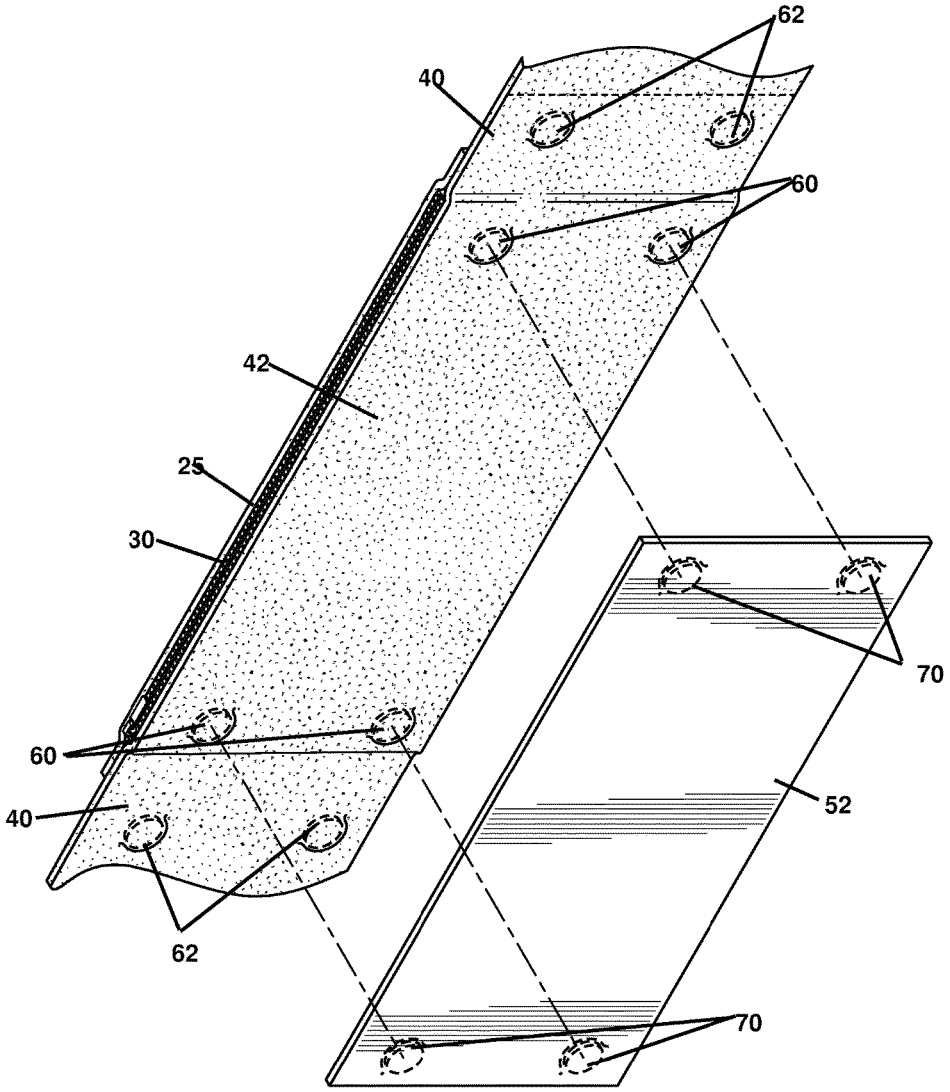
FIG. 9 shows an exploded view of a belt and front cover of embodiments of the disclosed technology.
Figure 10:
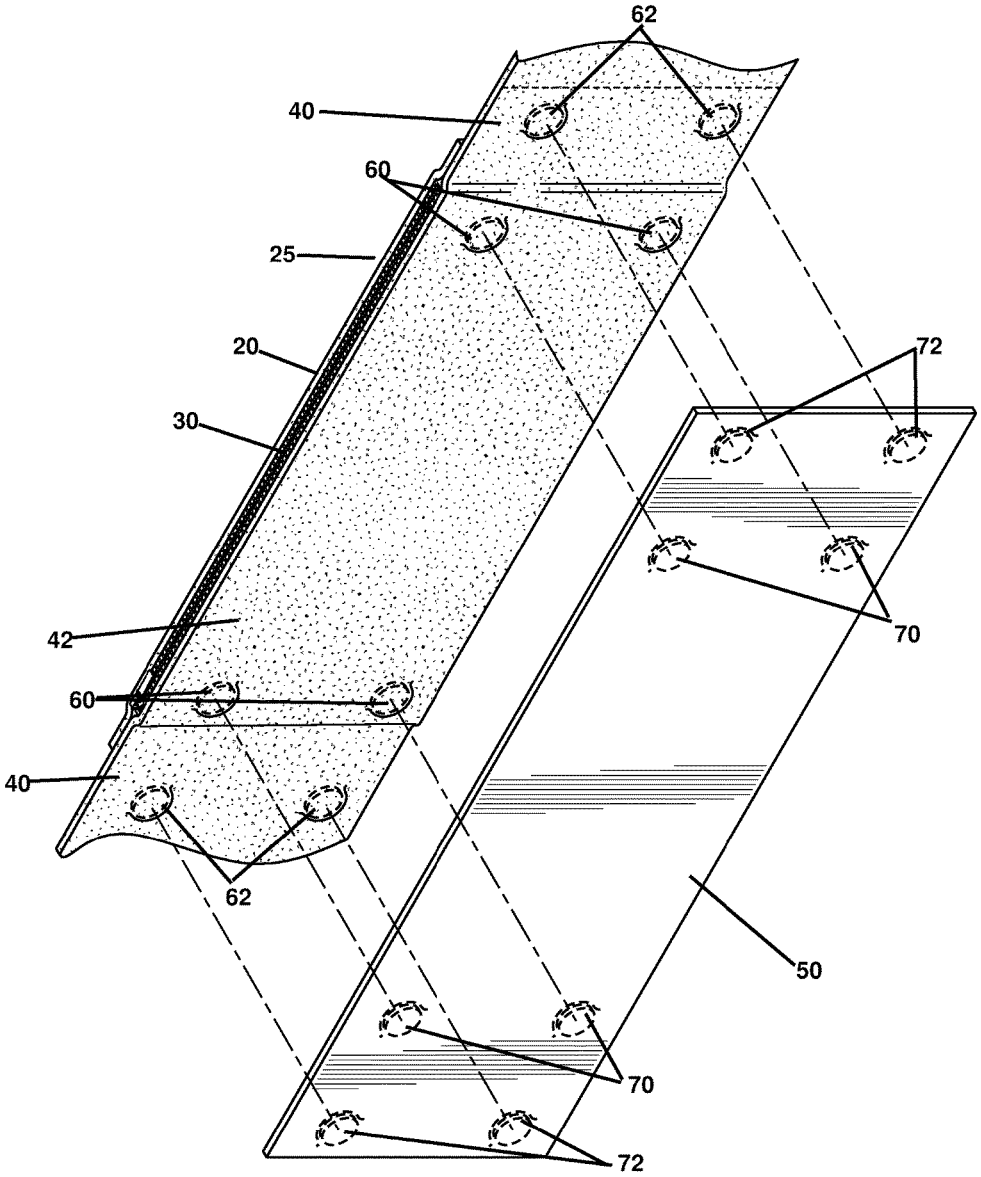
FIG. 10 shows an exploded view of a belt and larger front cover of embodiments of the disclosed technology.

FIG. 9 shows an exploded view of a belt and front cover of embodiments of the disclosed technology. FIG. 10 shows an exploded view of a belt and larger front cover of embodiments of the disclosed technology. Note that there are two different covers shown in FIGS. 9 and 10. The cover 50 of FIG. 10 is smaller than the cover 52 of FIG. 9. The smaller cover 50 has a first set 70 of connectors on each left and right side (four total, in this embodiment). They are the same distance apart as inner sets of connectors 60 of the belt 40. Meanwhile, the larger cover 52 has a set of connectors 72 where the right and left sets are further away from each other than that of the connectors 70 of cover 52. This larger cover 52 can also comprise the connectors 70 in addition to the connectors 72, in embodiments of the disclosed technology. The receptacle 20 with top opening 30 can span the length, or substantially the length, between the left and right connectors 70 and/or the left and right connectors 72. The respective connectors on the belt have numerals decreased by 10, such that the connectors 72 of the cover correspond to the connector 62 of the belt and the connectors 70 of the cover correspond to the connectors 60 of the belt.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

The invention claimed is:

1. A belt comprising:

a belt with connectors at extreme and opposite ends thereof, the belt having a first broad surface and a second broad surface, parallel to said first broad surface;

a removable front portion;

a receptacle within said belt with an opening only on a surface of said belt which is transverse to said first and second broad surfaces of said belt and to a surface of said removable front portion;

front portion connectors fixed to said front portion comprising:

a set of left side connectors;

a set of right side connectors;

at least one set of belt connectors fixed to said belt comprising:

a set of left side connectors;

a set of right side connectors;

wherein a distance between said left side connectors of said front portion to said right side connectors of said front portion is equal to a distance from said left side connectors of said belt to said right side connectors of said belt;

wherein said belt comprises a second set of said belt connectors which are spaced apart from each other more than a first set of said belt connectors;

said connectors of said front portion are distanced from each other such that, when said belt is laid flat on a planar surface, they are connectable only to said first set of belt connectors; and a second removable front portion, having a greater length than said front portion, has left side connectors and right side connectors which are spaced from each other a distance equal to that of said second set of said belt connectors, and are connectable at least to said second set of belt connectors.

2. The belt of claim 1, wherein said removable front portion and said second removable front portion are interchangeably and removably connectable to said belt.

3. The belt of claim 2, wherein at least one of said removable front portion of said second removable front portion comprises fabric cut from a dress over which said belt is worn.

4. The belt of claim 2, wherein at least one of said removable front portion of said second removable front portion comprises a pattern which is on a portion of a dress over which said belt is worn.

5. The belt of claim 2, wherein each of said front portion connectors and said belt connectors are magnets sewn inside fabric of respective said front portions and said belt.

6. The belt of claim 5, wherein each set of left side connectors and each set of right side connectors of each respective said front portion and/or said belt comprises two, spaced-apart magnets on each said left side and said right side.

7. The belt of claim 5, wherein each set of said connectors comprises at least two separate magnets, wherein each of said at least two separate magnets is equidistant from one of said connectors at said extreme end of said belt.

8. The belt of claim 7, wherein said belt comprises a continuous length of fabric between said extreme and opposite ends thereof, and said receptacle is fixedly connected to an inside of said belt, said inside being defined as a side of said belt opposite a side adjacent to and removably connected to said removable front portion.

9. The belt of claim 8, wherein said receptacle is sealable along substantially an entirety of one edge thereof, and is fixedly sealed along lengths of at least three other edges.

10. A method of wearing said belt of claim 1, comprising the steps of, in any order:

aligning said left-side and said right-side connectors of a one of said removable front portion or said second removable front portion with respective said left-side and said right-side connectors of said belt;

removably attaching one of said removable front portion or said second removable front portion to said belt;

attaching extreme and opposite ends of said belt to each other such that said opening of said receptacle points substantially upward relative to the ground or a wearer of said belt.

11. The method of claim 10, further comprising a step of removing said removable front portion or said second removable front portion and attaching a third removable front portion by aligning its connectors with that of said connectors of said belt.

12. The method of claim 11, further comprising a step of placing an item in said receptacle while donning said belt.

13. The belt of claim 9, wherein said front-portion connectors are substantially equidistant from a center of a length of said belt.

* * * * *